United States Patent [19]

Dehm

[11] 4,038,115

[45] July 26, 1977

[54] COMPOSITE MODIFIED DOUBLE-BASE PROPELLANT WITH FILLER BONDING AGENT

[75] Inventor: Henry C. Dehm, Salt Lake City, Utah

[73] Assignee: Hercules Incorporated, Wilmington, Del.

[21] Appl. No.: 868,666

[22] Filed: Oct. 7, 1969

[51] Int. Cl.[2] ..... C06B 45/10

[52] U.S. Cl. ..... 149/19.8; 149/7; 149/11; 149/20

[58] Field of Search ..... 149/6, 7, 8, 19, 19.8, 149/11, 20

[56] References Cited

U.S. PATENT DOCUMENTS

| | | | |
|---|---|---|---|
| 3,215,573 | 11/1965 | Winkler | 149/7 |
| 3,309,247 | 3/1967 | Bluhm | 149/8 |
| 3,373,062 | 3/1968 | Morris | 149/6 |
| 3,480,488 | 11/1969 | Rudy et al. | 149/7 |

*Primary Examiner*—Edward A. Miller

*Attorney, Agent, or Firm*—Michael B. Keehan; Hazel L. Deming

[57] ABSTRACT

Mechanical properties of composite modified double-base propellant are improved by coating fillers for the propellant with a crosslinked, binder insoluble coating having reactive surface isocyanate groups. The reactive isocyanate groups become chemically bound to the nitrocellulose binder of the propellant during propellant cure. Failure of the propellant at the binder-filler interface under conditions of stress is substantially reduced.

12 Claims, No Drawings

COMPOSITE MODIFIED DOUBLE-BASE PROPELLANT WITH FILLER BONDING AGENT

This invention relates to a process for preparing composite modified double-base propellant having improved mechanical properties. More particularly this invention relates to a process of providing a coating on fillers to be incorporated into a composite modified double-base propellant, which coating becomes chemically bound to the nitrocellulose binder during the cure of the propellant.

Composite modified double-base propellants sometimes referred to hereinafter as CMDB propellants, are comprised of a solid suspension of solid oxidizers and fuels in a binder consisting of a solution of nitrocellulose in an energetic plasticizer such as nitroglycerin. The suspended solids are referred to herein as fillers and are generally employed in the form of particles having a diameter of about 1$\mu$ to about 600$\mu$. Binders for CMDB propellants made by the slurry process often contain a crosslinker for nitrocellulose which is usually a diisocyanate such as tolylene diisocyanate or a longer chain diisocyanate such as that derived from polyethyleneglycol adipate and tolylene diisocyanate. The function of the crosslinker is to improve the mechanical properties of the cured propellant.

It has been discovered by various researchers in the field of solid propellants, that mechanical failure of slurry cast composite modified double-phase propellant resulting from environmental and operating stresses occurs at or about the binder-filler interfaces of the propellant, rather than in the propellant binder. For example, when a slurry cast isocyanate-crosslinked CMDB propellant is sufficiently deformed, small vacuoles appear in the binder phase near the largest particles. The vacuoles grow until they are essentially tangent to the filler surface. Additional stress causes the binder to peel away from the filler surface. Such a failure process is sometimes referred to as dewetting. The resulting stress concentrates lead to loss of propellant strength. Before the onset of vacuole formation, the stress-strain behavior of slurry cast CMDB propellants depends mainly on the packing characteristics, concentration of the filler and the binder crosslink density. The loss of structural support of the filler results in yield in the stress-strain curve and in inferior mechanical properties. The mechanical properties of CMDB propellants are of critical importance in ensuring reliable performance under the severe conditions imposed by modern weapon system requirements. CMDB propellants that dewet under stress have reduced resistance to mechanical failure.

Accordingly, it is an object of this invention to provide fillers for CMDB propellants with a crosslinked binder insoluble coating having surface isocyanate groups and a process for preparation of the coating.

It is another object of this invention to provide slurry cast composite modified double-base propellants having improved mechanical properties.

Other objects of this invention will, in part, be obvious and will in part, appear hereinafter. For a complete understanding of the nature and objects of this invention, reference is made to the following detailed description.

Broadly, in accordance with this invention a filler for CMDB propellant is provided with a binder-insoluble, crosslinked coating having reactive surfaces isocyanate groups by a process comprising (a) coating the filler with a polyol, and (b) reacting the polyol coated filler with an organic isocyanate having an insocyanate functionality of at least 3.0 in the presence of a catalyst. When the resulting fillers are employed in preparation of CMDB propellants the surface isocyanate groups of the filler coating react with the hydroxyl groups of the nitrocellulose binder and become chemically bound thereto. The resulting propellant has improved mechanical properties.

Filler materials that can be provided with a crosslinked coating having surface NCO groups in accordance with this invention include inorganic oxidizer salts such as ammonium nitrate and ammonium perchlorate; organic oxidizers such as cyclotrimethylene trinitriamine (RDX), cyclotetramethylene tetranitramine (HMX), and metal fuels such as aluminum, aluminum hydride, beryllium, beryllium hydride and the like. Other solid fillers to be incorporated into the CMDB propellant can also be provided with the crosslinked coating having surface NCO groups as long as a polyol will adhere to the surface of the solid to be coated and will be compatible therewith.

Illustrative polyols which can be employed to coat fillers in the process of this invention include straight and branched chain aliphatic polyhydric alcohols such as 1,2-propanediol; 1,3-propanediol; 1,4-butanediol; 1,3-hexanediol; 1,8-octanediol; glycerol; the tetrahydric alcohols such as d-, l-, and meso-erythritol; pentaerythritol; the pentitols such as xylitol; the hexitols such as sorbitol; aminoalcohols such as diethanolamine, triethanolamine, tris-(hydroxymethyl)-aminomethane; polymeric polyols such as nitrocellulose; polysaccharides such as sucrose; polyvinyl alcohol, and the like. It is generally preferred to employ a polyol having at least one hydroxyl group (—-OH) for every four carbon atoms in the polyol. Mixtures of two or more polyols can be employed. Filler coating is accomplished employing the polyol dissolved in a solvent.

Choice of a polyol for use with a particular filler is dependent on the solubility of the polyol in a solvent which is preferably a total non-solvent for the filler to be coated. For example, water-soluble fillers such as ammonium perchlorate cannot be coated with polyols that are soluble only in water or other highly polar solvents, since this type of solvent will dissolve the filler as well as the polyol. Polyols that are soluble in solvents such as benzene, toluene, diethyl ether, and methylene chloride which are non-solvents for ionic fillers can be readily applied even when the degree of solubility of the polyol in the solvent is on the order of 0.5 percent or less.

Other factors which are considered in the choice of a solvent are cost, stability, compatibility and volatility. Solvents having boiling points of 100° C. or lower are generally preferred since they are more easily removed at reduced pressure from the filter-solvent-polyol mixture.

Coating of filler particles with polyol is accomplished by admixing the filler particles, polyol and polyol solvent which is preferably an aprotic solvent, and subsequently removing the polyol solvent from the admixture employing any suitable means such as vacuum stripping employing a rotary evaporator operating at reduced pressure. The polyol is deposited on the surface of the filler during solvent removal. When coating a filler such as ammonium perchlorate with a polyol which is an aminoalcohol such as diethanol amine, reaction takes place between the ammonium perchlorate filler and the polyol. Ammonia gas is liberated in the reaction. The reaction is substantially complete when liberation of ammonia gas can no longer be readily observed. During this reaction the aminoalcohol becomes chemically bonded to the surface of the ammonium perchlorate filler. With this combination of polyol and filler, the excess solvent can be removed from the polyol coated filler by decantation or centrifugation and dried. Particularly suitable solvents for use when ammonium perchlorate is employed as a filler are aromatic hydrocarbons such as benzene and toluene and chlorinated hydrocarbons such as methylene chloride and trichloroethylene.

The amount of polyol employed in the coating step of this invention is from about 0.05 to about 2.5% by weight of polyol, based on the weight of the filler. It is generally preferred, however, to employ from about 0.5 to about 2.0% by weight of polyol based on the weight of the filler. Substantially quantitative coating of the filler with polyol takes place in the coating step of this invention.

The polyol coating on the filler particles resulting from the coating step is soluble in liquid CMDB binder ingredients which include the energetic plasticizer such as nitroglycerin and non-energetic plasticizer such as triacetin to varying extents. Reaction of these polyol coated filler particles, however, with an organic isocyanate in th presence of a catalyst results in a cross-linked urethane coating having reactive surface isocyanate groups which is not soluble in the liquid CMDB binder ingredients. A suitable ratio of hydroxyl functionality of the polyol to NCO functionality of the organic isocyanate is from about ½ to about 1/20.

Reaction between the polyol-coated filler and isocyanate takes place at a satisfactory rate in a dry aprotic solvent at ambient temperature (22° C.). Higher temperatures can be employed if desired. Upper reaction temperature limits depend on the temperature stability characteristics of the filler being coated. A wide variety of catalysts known for promoting the urethane reaction can be employed including amines such as triethylamine; tetramethyl-1,3-butanediamine; triethylenediamine, and derivatives of metals including tin, bismuth, vanadium and iron, and in particular dibutylin dilaurate, dibutylin diacetate, bismuth nitrate and the like. The catalyst concentration employed in the reaction of polyol coated filler and isocyanate is dependent on catalyst composition. In general, catalyst concentration is from about 5% to about 50% by weight, based on the weight of the isocyanate.

The organic isocyanates employed in this invention have an isocyanate functionality of at least three, and preferably have as many isocyanate groups per molecule as possible. Organic isocyanate mixtures containing a substantial amount of organic isocyanate having a functionality of at least three, and having an average overall functionality of at least 2.5 can also be employed. In order to produce the highest possible concentration of isocyanate groups on the filler surface, the isocyanate should have the highest possible number of isocyanate groups per molecule. The hydroxyl-to-hydroxyl distance in the polyol used in the polyol coating of the filler should be as short as possible in order to maximize the number surface NCO groups.

Organic isocyanates having an NCO functionality of at least three include polymethylene polyphenyl isocyanates available commercially in the form of a mixture of isocyanates having an average NCO functionality of three and sold under the trade name PAPI. Other commercially available isocyanates containing isocyanates having an NCO functionality of at least three are available in the form of a mixture of organic isocyanates having an average NCO functionality of at least 2.5 and are sold under the trade name "Mondur MR."

In preparing the fillers for CMDB propellants with a coating having reactive surface NCO groups, it is necessary that all ingredients as well as the coated fillers be maintained dry to prevent reaction of the isocyanate groups with water.

The following example more fully illustrate this invention. All parts and percentages are by weight unless otherwise specified.

EXAMPLE 1

About 5000 parts of benzene containing 10 parts of triethanolamine dissolved therein is charged to a reaction vessel. To this solution is added 1000 parts of ammonium perchlorate. This admixture is agitated by sparging of dry air through the admixture which is maintained at ambient temperature (22° C.). Ammonia gas is liberated during reaction and is removed by the sparging gas. After 2 hours of mixing, coating is complete. The resulting product is separated from the admixing by suction filtration. The product is dried in a stream of dry air. The coated ammonium perchlorate particles recovered contain about 1% coating of polyol based on the weight of the ammonium perchlorate particles.

Examples 2–5 illustrate coating of cyclotetramethylene tetranitramine (HMX) with various polyols.

EXAMPLE 2

About 200 parts of dry methanol containing two parts of dry 1,4-butanediol dissolved therein is charged to a round-bottom flask. To this solution is added 100 parts of 150μ HMX. The resulting admixture is free of methanol on a Rinco rotary evaporator operating at a reduced pressure of 20 mm. mercury and a temperature of 40° C. The polyol coated product recovered is further dried for 18 hours at a reduced pressure of 0.5 mm. mercury and a temperature of about 50° C. The resulting HMX particles are coated with 1,4-butanediol and are free flowing.

EXAMPLE 3

Example 2 is repeated substituting two parts of 1,8-octanediol for 1,4-butanediol. The resulting free-flowing HMX particles are coated with slightly less than 1% by weight of 1,8-octanediol based on the weight of the HMX particles.

EXAMPLE 4

Example 2 is repeated substituting two parts of plastisol grade nitrocellulose for 1,4-butanediol and dry ethyl acetate for methanol. The product is screened to give free-flowing HMX particles having a nitrocellulose coating of slightly less than 1% by weight based on the weight of the HMX particles.

EXAMPLE 5

About 200 parts of hot (60° C.) water containing one part of polyvinyl alcohol having a viscosity range of 4–6 centipoises (Hoepler) and available commercially as Elvanol 70–05 is charged to a round-bottom flask. To this solution is added 100 parts of 150μ HMX. The resulting mixture is freed of water on a Rinco rotary evaporator operating at a temperature of 40° C. and a reduced pressure of 20 mm. mercury. The resulting coated product is further dried for 18 hours at 0.5 mm. mercury and screened to break up agglomerates. The HMX particles contain slightly less than one percent Elvanol 70–05 coating based on the weight of the HMX.

Examples 6–23 are presented in Table I which follows. These examples illustrate the effects of varying process conditions in producing a crosslinked binder-insoluble coating having surface isocyanate groups on fillers to be incorporated into CMDB propellant. Process conditions are evaluated principally on the basis of the percentage of coated particles remaining insoluble after mixing the coated particles in a solvent for the filter particles for a period of ½ hour.

TABLE I

Reaction of Triethanolamine-Pretreated 144μ Ammonium Perchlorate (AP) with Various Isocyanates[1]

| Ex. No. | Percent Triethanolamine on AP | Isocyanate Name | Isocyanate (Grams) | NCO/OH* | Functionality Isocyanate Groups/ Molecule (Average) | Catalyst (grams) | Reaction Time (Hrs.) | % Insoluble[2] in water in 0.5 hr. | Percent Coating,[3] |
|---|---|---|---|---|---|---|---|---|---|
| 6 | 0 | — | — | — | — | — | — | 0 | 0 |
| 7 | 1.0 | — | — | — | — | — | — | 0 | 0 |
| 8 | 1.0 | HDI[4] | 0.30 | 2.34 | 2 | 0.10 | 48 | 1.8 | 1.8 |
| 9 | 1.0 | TDI[5] | 0.30 | 1.70 | 2 | 0.10 | 48 | 1.9 | 1.9 |
| 10 | 1.0 | PAPI[6] | 0.54 | 2.0 | 3[6] | 0.10 | 18 | 46.3 | 1.88 |
| 11 | 1.0 | P-PAPI[7] | 0.54 | 2.0 | 3+[7] | 0.10 | 18 | 78.8 | 1.56 |
| 12 | 1.0 | S-PAPI[8] | 0.54 | 2.0 | 2[8] | 0.10 | 18 | 1.68 | 1.68 |
| 13 | 1.0 | Mondur MR[9] | 0.54 | 2.0 | 2.7[9] | 0.10 | 18 | 46.0 | 1.9 |
| 14 | 1.0 | PAPI[6] | 0.54 | 2.0 | 3[6] | — | 18 | 0 | 0 |
| 15 | 1.0 | PAPI[6] | 0.54 | 2.0 | 3[6] | 0.0054 | 18 | 0.5 | 0.5 |
| 16 | 1.0 | PAPI[6] | 0.54 | 2.0 | 3[6] | 0.054 | 18 | 38.4 | 1.8 |
| 17 | 1.0 | PAPI[6] | 0.54 | 2.0 | 3[6] | 0.27 | 18 | 45.4 | 1.9 |
| 18 | 1.0 | PAPI[6] | 0.54 | 2.0 | 3[6] | 0.10[10] | 18 | 27.4 | 1.5 |
| 19 | 0.5 | PAPI[6] | 0.54 | 4.0 | 3[6] | 0.10 | 18 | 27.3 | 1.2 |
| 20 | 1.5 | PAPI[6] | 0.54 | 1.33 | 3[6] | 0.10 | 18 | 25.5 | 1.3 |
| 21 | 2.0 | PAPI[6] | 0.54 | 1.0 | 3[6] | 0.10 | 18 | 11.6 | 1.3 |
| 22 | 1.0 | PAPI[6] | 0.27 | 1.0 | 3[6] | 0.10 | 18 | 15.7 | 1.4 |
| 23 | 1.0 | PAPI[6] | 5.40 | 20 | 3[6] | 0.10 | 18 | 45.9 | 1.9 |

*Equivalents of NCO/Equivalents of OH

[1]All reactions are carried out on 10 grams of triethanolamine-pretreated ammonium perchlorate (AP) in a 180 ml. cylindrical bottle rotated at 60 rpm. on a pair of motor driven rolls at 22° C. Unless stated otherwise the catalyst is dibutyltin dilaurate and the reaction medium is 100 ml. of dry benzene.

[2]In this test the filler particles were swirled vigorously in a large excess of water in a Vortex mixer at room temperature for 0.5 hr., separated by suction filtration, washed once with water, followed quickly by suction filtration, dried and weighed. This crude test was used to determine the percentage of the filler particles completely covered with a solvent-resistant, binder-reactive coating.

[3]The particles were crushed to allow all the ammonium perchlorate to dissolve in water. The residue was washed exhaustively with water, dried, and weighed.

[4]Hexamethylene diisocyanate.

[5]Tolylene diisocyanate.

[6]Polymethylene polyphenylene isocyanates available commercially under the trade name "PAPI" from Upjohn Co. PAPI is a mixture of isocyanates having an average functionality of 3 but containing species having an isocyanate functionality as high as 8.

[7]A high molecular weight fraction of PAPI consisting of species having an NCO functionality of at least 3 or higher. The P-PAPI is dissolved in 5 ml. of dry ethyl acetate and then diluted with 95 ml. of dry benzene before reaction with the triethanolamine-treated ammonium perchlorate.

[8]Low molecular weight fraction of "PAPI" consisting mainly of diisocyanate species.

[9]"Mondur MR" is commercially available from Mobay Chemical Company. Mondur MR has an average isocyanate functionality of 2.7; one-half of the material is believed to be dissocyanate consisting of 2 phenylisocyanate radicals joined via a methylene bridge to the aromatic rings; about 45 percent is reported to consist of compounds having 3, 4 and 5 isocyanate groups per molecule, consisting of phenylisocyanate radicals bound to the original diisocyanate material and subsequent derivatives via methylene bridges; about 5 percent is reported to consist of related species having as many as 10 isocyanate groups per molecule.

[10]Bismuth nitrate catalyst.

In the foregoing table, Example 6 is used to illustrate complete solubility of ammonium perchlorate in water after ½ hour.

Example 7 illustrates the fact that ammonium perchlorate coated with triethanolamine as the polyol is completely soluble in water after ½ hour.

Examples 8 and 9 illustrate coating of ammonium perchlorate with triethanolamine and employing an isocyanate having a functionality of two gives a poor coating as evidenced by the low percent of insoluble particles.

Examples 10, 11, 13, 16, and 17 illustrate good water resistance and corresondingly a uniform binder-reactive coating on ammonium perchlorate filler coated with triethanolamine and reacted with an isocyanate having a functionality of three or greater.

Examples 10, 11, and 12 illustrate the relationship between the functionality of the isocyanate and the water resistance of the final coating.

Examples 10, 19, 20, and 21 illustrate varying amounts of polyol coating and their effect on the quality of the binder-reactive coating on the ammonium perchlorate as measured by water insolubility of the coated filler.

Example 14 illustrates the necessity for a catalyst in conducting the isocyanate-polyol reaction. Complete solubility of the ammonium perchlorate indicates no crosslinked binder-reactive coating.

Example 15 illustrates the poor reaction between the isocyanate and the polyol when catalyst is at the 1% level, based on the weight of isocyanate.

Examples 16 and 17 also illustrate the effects of variation in catalyst level in producing a binder-reactive coating.

Examples 10, 22, and 23 illustrate the effect of variation in the isocyanate concentration on the resulting binder-reactive coating.

Example 18 illustrates that a bismuth catalyst can be employed to produce a binder-reactive coating on ammonium perchlorate.

Examples 24–31 are presented in Table II. These examples illustrate the effect of various polyols and process conditions in producing a crosslinked binder-insoluble coating having reactive surface-NCO groups on cyclotetramethylene tetranitramine (HMX) employing high molecular weight polymethylene polyphenyl isocyanate to crosslink the polyol.

TABLE II

Reaction of Polyol-Pretreated 150μ HMX with a High Molecular Weight Fraction of PAPI[1]

| Example | Polyol | C/OH | % Insoluble in Acetone[2] Before Reacting with P-PAPI | After Reacting with P-PAPI | Equivalents NCO/ Equivalents OH |
|---|---|---|---|---|---|
| 24 | 0 | — | 0 | | — |
| 25 | Polyvinyl alcohol[3] | 2 | 0.83 | 60.5 | 0.91 |
| 26 | Polyvinyl alcohol[4] | 2 | 0.94 | 35.0 | 0.91 |
| 27 | Polyvinyl alcohol[5] | 2 | 0.87 | 33.5 | 0.91 |
| 28 | 1,4-Butanediol | 2 | 0 | 53.2 | 0.91 |
| 29 | 1,8-Octanediol | 4 | 0 | 44.7 | 1.47 |
| 30 | Glycerol | 1 | 0 | 44.0 | 0.62 |
| 31 | Plastisol nitrocellulose | 10.9 | 0 | 30.2 | 10.0 |

[1]In all cases the reactions were run as in Table I, Example 11, except that the 150μ HMX was coated with 2% polyol. All of the final urethane coatings weighed 1-2% of the coated product.
[2]Determined exactly as in Table I, Footnote 2, except acetone (a good solvent for HMX) was used in place of water.
[3]"Elvanol 70-05", 4-6 centipoise viscosity*.
[4]"Elvanol 71-30", 28-32 centipoise viscosity*.
[5]"Elvanol 72-60", 55-65 centipoise viscosity*.
*Viscosity in centipoise of a 4% water solution at 20° C. determined by means of the Hoepler falling ball method.

Examples 32–38 which follow illustrate improved mechanical properties of composite modified double-phase propellant prepared with fillers having a crosslinked binder-insoluble coating having reactive surface isocyanate groups. In these examples a crosslinked CMDB binder having the following composition is employed.

| | |
|---|---|
| Nitrocellulose (plastisol grade) | 18.43% |
| Nitroglycerin | 65.77% |
| Diisocyanate crosslinker PGA/TDI* | 10.54% |
| Dibutyltin dilaurate | 0.005% |
| m-Dimethoxybenzene | 5.28% |

*Polyglycol adipate-tolylene diisocyanate prepolymer; molecular weight 1000.

Into propellant binder having the above formulation coated and uncoated ammonium perchlorate, and HMX are incorporated. Mechanical property data at the rupture point for the resulting cured propellants is set forth in Table III.

TABLE III

Effect of Coated Filler Particles on the Mechanical Properties of Crosslinked CMDB Propellant*

| Example | Filler | Filler Volume Percent | Filler Treatment | Rupture Tensile (p.s.i.) | Rupture Elongaton (%) | Rupture Modulus (p.s.i.) |
|---|---|---|---|---|---|---|
| 32 | None (Binder only) | 0 | None | 117 | 67 | 110 |
| 33 | AP (Control) | 16.4 | None | 53 | 44 | 153 |
| 34 | (Coated) | 16.4 | Prepared in Example 1 & 11 | 62 | 54 | 53 |
| 35 | (Control) | 22.5 | None | 51 | 48 | 102 |
| 36 | (Coated) | 22.5 | Prepared in Example 1 & 11 | 92 | 66 | 81 |
| 37 | HMX (Control) | 16.7 | None | 61 | 48 | 147 |
| 38 | (Coated) | 16.7 | Prepared in Example 2 & 28 | 109 | 54 | 165 |

*JANAF specimens tested at 77° F. and a strain rate of 0.74 in./in./min.

In all of the foregoing examples, photomicrographs are taken. In all cases, propellant prepared from non-coated fillers failed at or very close to the binder-filler interfere, indicating dewetting of the filler from the binder. The tensile specimen fracture surface consists of loose, bare filler particles and empty sockets that once held filler particles. Conversely, the corresponding propellants made from fillers having a crosslinked binder-insoluble coating leaving reactive surface-NCO groups failed completely in the binder phase, indicating substantially total reduction of dewetting. Under the microscope, the fracture surface of the propellant appears as a continuum of binder. There are no sockets or bare particles visible.

What I claim and desire to protect by Letters Patent is:

1. A process for providing fillers for composite modified double-base propellant with a crosslinked, binder-insoluble coating having reactive surface-NCO groups, said process comprising, a. coating at least one filler for a composite modified double-base propellant and selected from the group consisting of inorganic oxidizer salts, organic oxidizers and metal fuels with a polyol, b. reacting the polyol coated filler with an organic isocyanate having an NCO functionality of at least three in the presence of a catalyst, and c. recovering a filler for composite modified double-base propellant having a crosslinked, binder-insoluble coating having reactive surface-NCO groups.

2. The process of claim 1 in which the polyol has at least one hydroxyl group for every four carbon atoms of the polyol.

3. The process of claim 2 in which the ratio of hydroxyl functionality of the polyol to NCO functionality of the organic isocyanate is from about $\frac{1}{2}$ to about 1/20.

4. The process of claim 3 in which the amount of polyol employed in the polyol coating step is from about 0.05 to about 2.5% by weight, based on the weight of the filler.

5. A process for providing fillers for composite modified double-base propellant with a crosslinked, binder-insoluble coating having reactive surface-NCO groups, said process comprising a. mixing a filler selected from the group consisting of cyclotetramethylene tetranitramine (HMX), cyclotrimethylene trinitramine (RDX), and mixtures thereof, and a polyol dissolved in an aprotic solvent, said aprotic solvent being a non-solvent for the filler, b. removing the polyol solvent from the admixture whereby the polyol is deposited on the surface of the filler, c. reacting the polyol coated filler with an organic isocyanate having an NCO functionality of at least three in the presence of a catalyst, and d. recovering the filler having a crosslinked, binder-insoluble coating having reactive surface-NCO groups.

6. A process for providing filler for composite modified double-base propellant with a crosslinked, binder-insoluble coating having reactive surface-NCO groups, said process comprising, a. admixing a filler selected from the group consisting of ammonium nitrate, ammonium perchlorate and mixtures thereof and a polyol which is an aminoalcohol, said polyol being dissolved in an aprotic solvent which is a non-solvent for the filler, until substantially complete reaction between the filler and the amino-alcohol has taken place, b. reacting the polyol coated filler with an isocyanate having an NCO functionality of at least three in the presence of a catalyst, and c. recovering a filler having a crosslinked, binder-insoluble coating having reactive surface-NCO groups.

7. In the process of preparing composite modified double-base propellant by slurry casting, the improvement whereby dewetting of filler particles from the binder under conditions of stress is reduced said improvement comprising admixing with the uncured propellant ingredients at least one filler selected from the group consisting of inorganic oxidizer salts, organic oxidizers and metal fluids, said filler having a crosslinked, binder-insoluble coating having reactive surface-NCO groups, and curing the resulting propellant.

8. The process of claim 7 in which the filler having a crosslinked, binder-insoluble coating having reactive surface-NCO groups is prepared by the process of claim 1.

9. The process of claim 7 in which the filler having a crosslinked, binder-insoluble coating having reactive surface-NCO groups is a filler coated by the process of claim 5.

10. The process of claim 7 in which the filler having a crosslinked, binder-insoluble coating having reactive surface-NCO groups is a filler coated by the process of claim 6.

11. The cured composite modified double-base propellant prepared in accordance with the process of claim 7.

12. The cured composite modified double-base propellant prepared in accordance with claim 8.

* * * * *